US012454871B2

(12) United States Patent
Vinge et al.

(10) Patent No.: US 12,454,871 B2
(45) Date of Patent: Oct. 28, 2025

(54) DOWNHOLE TOOL, ASSEMBLY AND ASSOCIATED METHODS

(71) Applicant: Equinor Energy AS, Stavanger (NO)

(72) Inventors: Torstein Vinge, Trondheim (NO); Tommy Øvstebø, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 18/715,266

(22) PCT Filed: Nov. 29, 2022

(86) PCT No.: PCT/NO2022/050274

§ 371 (c)(1),
(2) Date: May 31, 2024

(87) PCT Pub. No.: WO2023/101560

PCT Pub. Date: Jun. 8, 2023

(65) Prior Publication Data

US 2025/0020039 A1 Jan. 16, 2025

(30) Foreign Application Priority Data

Dec. 2, 2021 (GB) ..... 2117446

(51) Int. Cl.
*E21B 33/04* (2006.01)
*E21B 34/02* (2006.01)

(52) U.S. Cl.
CPC ..... *E21B 33/04* (2013.01); *E21B 34/02* (2013.01)

(58) Field of Classification Search
CPC combination set(s) only.
See application file for complete search history.

(56) References Cited

U.S. PATENT DOCUMENTS 4,474,236 A 10/1984 Kellett
6,186,237 B1 * 2/2001 Voss, Jr. ..... E21B 34/04 166/348
2011/0247799 A1 * 10/2011 June ..... E21B 23/10 166/212

FOREIGN PATENT DOCUMENTS

GB 2 437 286 A 10/2007
WO WO 2010/033161 A2 3/2010
(Continued)

OTHER PUBLICATIONS

International Search Report, issued in PCT/NO2022/050274, dated Jan. 13, 2023.
(Continued)

*Primary Examiner* — James G Sayre
(74) *Attorney, Agent, or Firm* — Birch, Stewart, Kolasch & Birch, LLP

(57) ABSTRACT

A downhole tool for installing a tubing hanger in a well without an umbilical includes a body defining a primary flow path; a first connector at a first end of the body for mechanically connecting the tool to a tubing hanger; a second connector at a second end of the body for mechanically connecting the tool to a tubular or tool handling equipment; a locking actuator configured to move from a running position to a locking position under the action of fluid pressure, the actuator including an interface for engaging and moving a lock of a tubing hanger into a locked position as the actuator moves to the locking position; and a bypass valve activating system configured to operate a tubing hanger annulus bypass valve. The downhole tool is configured to move the locking actuator from the running position to the locking position, and operate a tubing hanger annulus bypass valve, without the use of an umbilical.

12 Claims, 2 Drawing Sheets

(56) References Cited

FOREIGN PATENT DOCUMENTS

| | | | |
|---|---|---|---|
| WO | WO 2015/006119 | A1 | 1/2015 |
| WO | WO 2016/182449 | A1 | 11/2016 |

OTHER PUBLICATIONS

United Kingdom Combined Search and Examination Report, issued in Priority Application No. 2117446.1, dated May 25, 2022.
United Kingdom Corrected Searh Report, issued in Priority Application No. 2117446.1, dated May 24, 2022.
Written Opinion of the International Searching Authority, issued in PCT/NO2022/050274, dated Jan. 13, 2023.

* cited by examiner

DOWNHOLE TOOL, ASSEMBLY AND ASSOCIATED METHODS

FIELD

The present invention relates to a downhole tool, assembly and associated methods, in particular relating to tubing hanger running tools and methods for installing tubing hangers from a well.

BACKGROUND

In oil and gas wells, a tubing hanger is used to suspend production tubing from a wellhead. This allows the production tubing to extend into the well for transporting hydrocarbons to the wellhead.

A tubing hanger is typically connected to an upper end of the production tubing and is equipped with a lock for anchoring the tubing hanger at the top of the well, located on the seabed. Once the tubing hanger is anchored, the production tubing extends into the well.

Christmas trees are located at a wellhead and are used to control flow into and out of a well. There are two main types of Christmas trees, horizontal Christmas trees (HXT) and vertical Christmas trees (VXT). The different types of Christmas trees have different arrangements and are used in different environments. In a HXT the tubing hanger is connected to the HXT inside the HXT. With a VXT the tubing hanger is anchored inside the wellhead.

In light of the different arrangements between HXTs and VXTs, tubing hangers for use in VXTs have different functional requirements than those used in HXTs. A key difference is that tubing hangers for use in VXTs require an annulus bypass and an annulus isolation valve for permitting and preventing fluid communication between an upper annulus and a lower annulus.

Typically, tubing hangers (TH) are run in, anchored and removed using tubing hanger running tools (THRT). The tubing hanger running tool supports the weight of the tubing hanger and production tubing as it is run into the well. It also actuates the locking mechanism within the tubing hanger to anchor the tubing hanger to the wellhead or HXT. When used with VXTs, the tubing hanger running tool must also be able to operate the annulus isolation valve in the tubing hanger.

Traditional tubing hanger running tools include an umbilical connected to the surface. The umbilical provides electrical power and hydraulic capabilities to the tubing hanger running tool, which allows it to perform the necessary functions and undertake certain tests. These tubing hanger running tools are complex and expensive.

When running a THRT with an umbilical, the umbilical must be clamped to the drillpipe being run into the well. Typically a clamp will be required roughly every 25-35 metres. Each time a clamp is applied to the string, the running sequence must be halted and personnel have to work under hanging load to fix the umbilical to the drillpipe using a clamp. During running an additional operator is required to pay out the umbilical as the drillpipe is lowered. The use of an umbilical also requires a specific umbilical winch, which in turn requires hydraulic power. Connecting a hydraulic power unit to the umbilical winch is not straightforward and is often the source of errors.

All of the above actions and requirements associated with the use of an umbilical take time, incur costs, increase the complexity of the process and can result in errors.

Furthermore, the use of an umbilical winch requires power to be operated and the umbilical hydraulic lines will need power from a Hydraulic Power Unit (HPU). The HPU must be connected to the hydraulic lines via a jumper cable, but this cable can only be connected to the winch when this is static (not rotating as paying out or reeling in the umbilical). This means that the winch must be equipped with isolation valves for each hydraulic line.

Connecting the jumper to and from the umbilical winch takes time, and it is a source of errors and misunderstandings on hydraulic functioning.

Similarly, when retrieving the hydraulic THRT, the umbilical clamps will have to be removed using personnel working in the red zone (under hanging load).

SUMMARY

The present disclosure provides a downhole tool, assembly and associated methods for installing tubing hangers into a well. In particular, the present disclosure provides mechanical tools assemblies and methods for installing tubing hangers in wells, such as wells using VXTs.

The embodiments of the disclosure are mechanically operated and do not require the use of an umbilical. As such, the tool can be more robust and the installation and removal process can be greatly simplified, reducing costs and eliminating the risk of the umbilical being damaged, dropping clamps into the well and reducing the number of personnel working under hanging load.

According to the disclosure is a downhole tool for installing a tubing hanger in a well without an umbilical. The downhole tool may be a tubing hanger running tool. The tool may comprise a body, which may define a primary flow path. The tool may further comprise a first connector at a first end of the body, which may be for (or configured to) mechanically connecting the tool to a tubing hanger. The tool may further comprise a second connector at a second end of the body, which may be for (or configured to) mechanically connecting the tool to a tubular or tool handling equipment. The tool may further comprise a locking actuator. The locking actuator may be configured to move from a running position to a locking position under the action of fluid pressure. The actuator may comprise an interface for engaging and moving a lock of a tubing hanger into a locked position as the actuator moves to a locking position. The tool may further comprise a bypass valve activating system. The bypass valve activating system may be configured to operate a tubing hanger annulus bypass valve.

The downhole tool may be configured to move the locking actuator from the running position to the locking position, and operate a tubing hanger annulus bypass valve, without the use of an umbilical The downhole tool may not comprise an umbilical or a connector for receiving an umbilical.

An umbilical may be used to provide electrical or hydraulic and/or pneumatic power to a downhole tool. The umbilical may be a conduit from the surface to the tool to provide independent power and/or control to the downhole tool.

The downhole tool provided herein may be configured to operate without the use of an umbilical—that is, without the need for an independent electrical and/or hydraulic supply. Instead, the downhole tool may be configured to operate solely hydraulically—for example using existing hydraulic lines within the well.

The downhole tool may be configured to install a tubing hanger in a well without the use of an umbilical. The downhole tool may be a (solely) mechanical tool. The downhole tool may be configured to install a tubing hanger without the use of separate or additional hydraulic power. The downhole tool may be fully mechanical—that is, it may be fully hydraulically actuated or controlled. The downhole tool may comprise only hydraulically-actuated functionality. The downhole tool may be configured to operate solely under the action of tubing, drill string or kill line fluid pressure.

The body may be a housing. The body may be substantially tubular. The primary flow path may be a longitudinal flow path along the longitudinal axis of the body. The primary flow path may be configured to connect to a flow path through the tubing hanger, production tubing and/or a drill string flow path.

The tool may comprise a mechanical connector at either end. The connector at the first end (a lower end during use) may be configured to mechanically connect to and support the load of a tubing hanger (and production tubing). The connector at the second end (the upper end during use) may be configured to connect to a tubular or tool handling equipment, for handling the tubing hanger running tool and/or lowering it into the well.

The first connector may be fluid actuated. The first connector may comprise a fluid-actuated ring configured to move from a disconnected to a connected position. The ring may slide axially. The ring may urge a connector lock radially to engage the tubing hanger. The ring may be configured to engage or release locking pins for locking the tubing hanger running tool with respect to a tubing hanger. The connector may further comprise shear pins, configured to be sheared when the tubing hanger running tool separates from the tubing hanger.

The locking actuator may be a mechanical locking actuator. The locking actuator may be only hydraulically actuated. The locking actuator may be configured to actuate under the action of tubing, drill string or kill line fluid pressure.

The locking actuator may be configured to cause a tubing hanger to engage a wellhead. The locking actuator may be configured drive a tubing hanger into a locked position without the use of an umbilical.

The locking actuator may be configured to move between the running position and the locking position. In the running position, the locking actuator may not engage a lock of the tubing hanger. The locking actuator may be in a configuration in which the downhole tool and tubing hanger are free to move with respect to the wellhead. As the locking actuator moves to the locking position, it may cause the tubing hanger to move to a locked configuration, in which it is anchored to the wellhead. The locking actuator may therefore be responsible for locking the tubing hanger in a wellhead.

The locking actuator may be configured to move between the running position and the locking position under the action of fluid pressure. The fluid pressure may be kill line fluid pressure.

During use, the tubing hanger running tool may be located within a blowout preventer (BOP). The blowout prevent may comprise a ram or pair of cooperating rams. The rams may be configured to isolate an annular area above the locking actuator (e.g. from the rest of the annulus above the ram). The BOP may define a fluid line in fluid communication with the annular area above the locking actuator. The fluid line may be a kill line. The locking actuator may be configured to move from the running position to the locking position under the action of fluid pressure in the isolated annular area provided by the BOP fluid line.

Alternatively, the fluid pressure that moves the locking actuator between the running and locking positions may be wellbore fluid pressure, or fluid pressure within the downhole tool (e.g. within the primary flow path of the downhole tool). Having the locking actuator actuate the tubing hanger using tubular fluid pressure or kill line fluid pressure may remove the need for an umbilical.

The tool may define a locking flow path. The locking flow path may be configured to expose the locking actuator to fluid pressure to actuate the locking actuator. The locking flow path may be arranged to expose the locking actuator to fluid pressure within the primary flow path to urge the locking actuator from the running position to the locking position. The locking flow path may connect the locking actuator and the primary flow path. The locking flow path may be a passage connecting the primary flow path and the locking actuator.

The locking actuator may comprise a sleeve. The sleeve may be configured to move axially with respect to the downhole tool.

The sleeve may be for urging the tubing hanger lock, or a lock ring thereof, between an unlocked and a locked position.

The downhole tool may define a chamber. The sleeve may be located in the chamber and the tool may be configured such that one side of the sleeve is exposed to an elevated pressure to actuate the sleeve—for example in a downwards direction towards the tubing hanger. The chamber may be in fluid connection with the primary flow path.

The interface of the locking actuator may be an abutment surface of the sleeve. The sleeve may be configured to move axially with respect to the body from the running position to the locking position under the action of fluid pressure.

The tool may be configured to selectively move the locking actuator between the running and locking positions. The tool may be configured to selectively expose the locking actuator to fluid pressure (e.g. tubular pressure).

The bypass valve activating system may be hydraulically controlled. The bypass valve activating system may be configured to operate solely under the action of fluid pressure. The bypass valve activating system may be configured to operate under the action of tubing, drill string or kill line fluid pressure The bypass valve activating system may be configured to functionally interface with a bypass valve of a tubing hanger. The bypass valve activating system may comprise an interface for functionally connecting to a bypass valve of a tubing hanger. The interface may be a fluid connector—for example for conveying fluid pressure to an associated bypass valve. The bypass valve activating system may be configured to move the bypass valve (e.g. of a connected tubing hanger) between an open and closed arrangement—i.e. from an open to a closed and/or from a closed to an open arrangement.

The bypass valve activating system may comprise, or be, a fluid pressure line. The fluid pressure line may be for conveying fluid pressure to operate a tubing hanger annulus bypass valve (for example associated with a connected tubing hanger).

The fluid pressure line may be in fluid communication with the primary flow path for conveying tubing pressure.

The fluid pressure line may be arranged to convey fluid pressure within the primary flow path (e.g. tubing pressure) to the bypass valve of a connected tubing hanger. Increased fluid pressure within the primary flow path may be used to operate the valve.

The fluid pressure line may be configured to connect to a choke/kill line of a blowout preventer.

The fluid pressure line may be arranged to convey fluid pressure within the choke/kill line of a blowout preventer to the bypass valve of a connected tubing hanger. Increased fluid pressure within the choke/kill line of a blowout preventer may be used to operate the valve.

The fluid pressure line may be configured to connect to an external or internal drill string pressure.

The fluid pressure line may be arranged to convey the external or internal drill string pressure to the bypass valve of a connected tubing hanger. Increased external or internal drill string pressure may be used to operate the valve.

Alternatively, rather than being configured to operate a tubing hanger bypass valve located in a connected tubing hanger, the downhole tool may comprise a valve configured to control the flow of fluid through the annular bypass. The bypass valve activating system may be configured to operate the valve to control the flow of fluid through the annular bypass.

The downhole tool may comprise a feedback system configured to provide a positive verification at the surface that the locking actuator is in a locking position, and/or that the tubing hanger is in a locked position.

The tool may comprise a return pressure line. The return pressure line may form the feedback system.

The return pressure line may be configured to convey an annulus pressure to the first end of the tool.

The return pressure line may be configured to be isolated from the annulus pressure when the locking actuator is in the running position, but in fluid communication with the annulus when the locking actuator is in the locking position.

The return pressure line may be configured to convey a fluid pressure to the wellhead (e.g. the surface or seabed). The return pressure line may be configured to be connected to the annulus above the locking actuator (i.e. the volume isolated by the BOP ram) when the locking actuator is in locking position. The tool may comprise a return pressure line configured to be put into fluid communication with an external surface of the tool (e.g. the annulus) when the locking actuator moves to the locking position. The return pressure line may be isolated from the annulus when the locking actuator is in the running position. Accordingly, when the locking actuator moves into a locking position, the return pressure line may be put into fluid communication with the annulus, such that a high pressure reading (from the annulus) can be detected on the surface, confirming that the locking actuator is in the locking position.

Further according to the disclosure is a downhole assembly. The downhole assembly may comprise a downhole tool as described anywhere herein. The downhole assembly may further comprise a tubing hanger connected to the downhole tool.

The tubing hanger may comprise a lock. The lock may be configured to move between an unlocked position and a locked position for engaging a wellhead and anchoring the tubing hanger to the wellhead. The lock may be configured to cooperate with the locking actuator of the downhole tool. The lock may be configured to move from an unlocked position to a locked position under the action of the locking actuator.

The tubing hanger may comprise an annulus bypass. The annulus bypass may be configured to provide fluid communication with an annulus below the tubing hanger. The tubing hanger may comprise a bypass valve arranged in the annulus bypass. The bypass valve may be configured to control fluid communication through the annulus bypass. The bypass valve may be connected to the bypass valve activating system. The bypass valve may be configured to be operated under the action of the bypass valve activating system.

The lock may comprise a lock ring, or locking member, and a wedge. The lock may be arranged such that the wedge is acted upon by the locking actuator of the downhole tool as the locking actuator moves to a locking position. The lock may be arranged such that the wedge is moved to engage the lock ring or locking member, forcing the lock ring or member radially outwards into a wellhead-engaging position.

The lock ring or member may be configured to move between a retracted and an extended position. In a retracted position the tubing hanger may be free to move within the wellhead. In the extended position, the lock ring or member may engage an inner surface, e.g. a shoulder, of the wellhead, anchoring the tubing hanger to the wellhead. The lock ring or member may be configured to move radially outwards from the retracted to the extended position.

The wedge may be configured to move the lock ring or member from the retracted to the extended position. The wedge may comprise a cam surface, against which the locking or member acts as the wedge is urged towards the lock ring or member by the locking actuator (e.g. sleeve). The cam surface may urge the lock ring or member radially outwards.

In use, as the locking actuator may moves from a running position to a locking position, it may engage the wedge of the tubing hanger and urge the wedge axially towards the lock ring or member. The cam surface of the wedge may engage the lock ring and, as the wedge moves axially, urge the lock ring or member radially outwards into a position where it can engage the inner profile of the wellhead, anchoring the tubing hanger in place.

The bypass valve may be configured to move between an open and a closed arrangement under the action of the bypass valve activating system.

The bypass valve may be configured to move between an open and a closed arrangement under the action of fluid pressure.

The bypass valve may comprise a gate valve. The bypass valve activating system may be configured to be in fluid connection with a fluid chamber comprising a piston. The piston may be connected to the valve member of the gate valve. Under the action of fluid pressure (or rather, a pressure differential) in the fluid chamber, the valve member may be urged between the open and closed arrangements.

The downhole assembly may comprise a blowout preventer, for example as described anywhere herein.

The blowout preventer may comprise a ram configured to isolate an annular area above the locking actuator; and a fluid line in fluid communication with the annular area above the locking actuator. The fluid line may be the kill line and may be configured to convey high pressure fluid—e.g. drilling mud. The high pressure fluid may be used to move the locking actuator from the running to the locking position.

The fluid pressure line of the bypass valve activating system may be configured to be in fluid communication with a fluid line—e.g. the kill line—of the BOP.

Further according to the disclosure is a method for installing a tubing hanger in a well without an umbilical. The method may comprise running an assembly as described anywhere herein into a well. The method may further comprise locating the tubing hanger in the wellhead. The method may further comprise moving the locking actuator from the running position to the locking position under the action of fluid pressure in the well. The method may further comprise moving the tubing hanger lock from the unlocked position to the locked position under the action of the locking actuator, such that the tubing hanger is anchored in the wellhead. The method may further comprise using the bypass valve activating system to operate the bypass valve. The method may further comprise disconnecting the downhole tool from the tubing hanger. The method may further comprise removing the downhole tool from the well.

Methods according to the present disclosure may be mechanical methods. The method may not comprise the use of an umbilical.

Further according to the disclosure is a method for running a completion in a well without an umbilical. The method may comprise running an assembly as described anywhere herein into a well. The method may further comprise locating the tubing hanger in the wellhead. The method may further comprise moving the locking actuator from the running position to the locking position under the action of fluid pressure in the well. The method may further comprise moving the tubing hanger lock from the unlocked position to the locked position under the action of the locking actuator, such that the tubing hanger is anchored in the wellhead. The method may further comprise using the bypass valve activating system to operate the bypass valve. The method may further comprise disconnecting the downhole tool from the tubing hanger. The method may further comprise removing the downhole tool from the well. The method may further comprise landing a vertical Christmas tree in the well before testing the tubing hanger within the wellhead. The method may further comprise testing the completion after the vertical Christmas tree has been installed in the well.

DETAILED DESCRIPTION OF DRAWINGS

Figure 1:
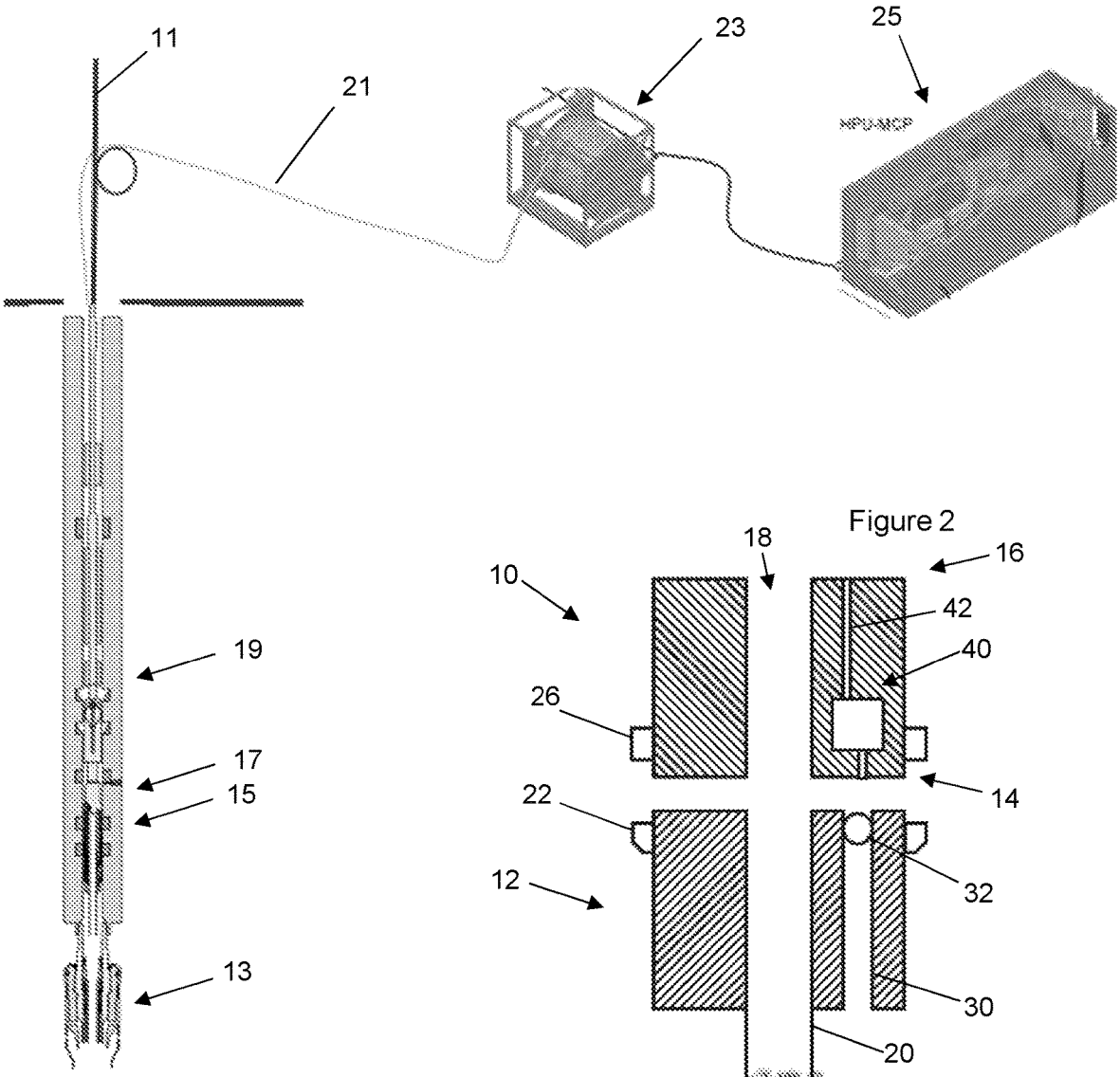
FIG. 1 is schematic illustration of a production tubing being run into a well according to the prior art.

FIG. 1 shows a method for landing a tubing hanger according to the prior art. A drillpipe 11 extends into a marine riser. A wellhead 13 is shown, with a tubing hanger 15 with a string of production tubing attached thereto being lowered into the well to be anchored in the wellhead 13. The tubing hanger 15 is supported by a tubing hanger running tool 17. Above the tubing hanger 15 and running tool 17 is a blowout preventer 19.

The tubing hanger running tool 17 is connected to an umbilical 21 which is being reeled out from a reel 23 on the drilling platform. The umbilical 21 is a conduit including a number of cables, pipes and connectors for transferring power, chemicals and communications between the downhole tool and the surface. The tubing hanger running tool 17 is controlled by a workover control system 25 on the surface, via the umbilical 21.

The tubing hanger running tool 17 is a complex tool, controlled by the umbilical.

After the tubing hanger 15 is installed in the wellhead 13 (but before landing of the VXT), a series of tests are carried out on the landed tubing hanger 15, using the tubing hanger running tool 17, which is controlled by the workover control system 25 via the umbilical 21.

Figure 2:
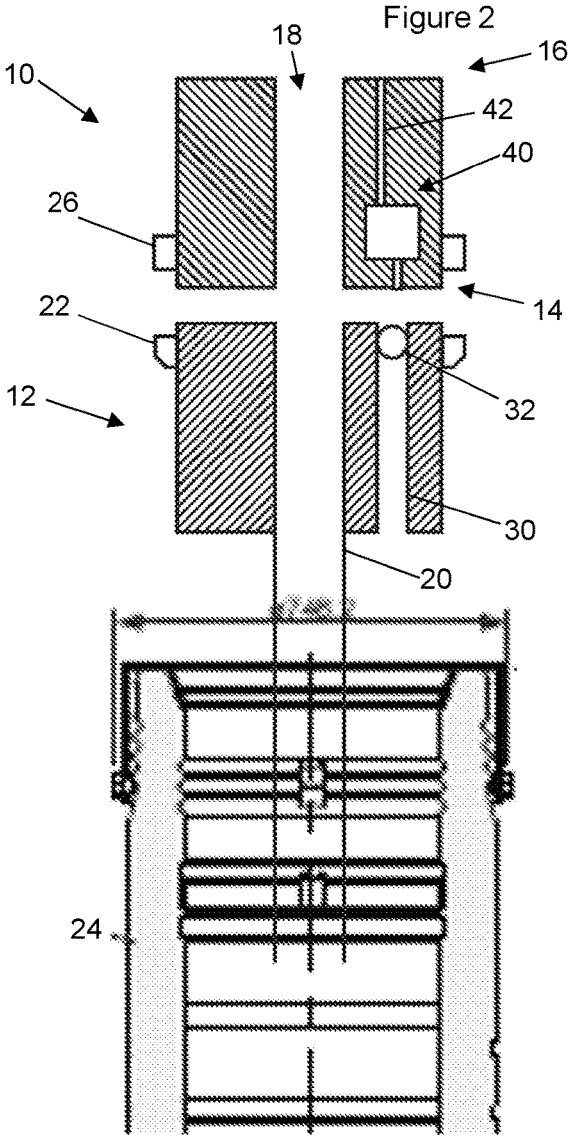
FIG. 2 is a schematic illustration of a tubing hanger running tool, tubing hanger and wellhead.

Turning now to FIG. 2, an assembly of a downhole tool 10 and a tubing hanger 12 is shown schematically. The downhole tool is a tubing hanger running tool 10. The tubing hanger running tool 10 has a body including a first end 14 for connecting to the tubing hanger 12 and a second end 16 for connecting to a tubular or tool handling equipment on the surface. The tubing hanger running tool 10 is substantially tubular and an internal bore defines a flow path 18 through the running tool 10. This central flow path may be connected, in use, to a drill string or production tubing flow path.

The first end 14 of the tubing hanger running tool 10 is connected to a tubing hanger 12. The tubing hanger 12 is also substantially tubular and defines an internal bore in communication with the flow path 18 of the tubing hanger running tool 10. Production tubing 20 is connected to the lower end of the tubing hanger 12. The production tubing 20 is to be installed in the well during use.

The tubing hanger running tool 10 is a mechanical tool. That is, the tubing hanger running tool 10 does not have an umbilical, and is not configured to connect to an umbilical. The tubing hanger running tool 10 of the present example is configured to operate using tubing pressure and fluid lines present in the drill string, it does not require electrical or hydraulic inputs from the surface or drill platform. The tubing hanger running tool 10 is configured to operate without an umbilical.

In order to install the production tubing 20 within the well, the tubing hanger 12 is anchored to the wellhead 24. In order to achieve this, the tubing hanger 12 includes a lock 22. The lock 22 is configured to selectively engage the wellhead 24 and anchor the tubing hanger 12 to the wellhead 24 so that the production tubing 20 is installed within the well.

The lock 22 is configured to move between an unlocked position, in which the lock 22 does not engage the wellhead 24 and the tubing hanger 12 is free to move within the wellhead 24; and a locked position, in which the lock ring engages the wellhead 24 and anchors the tubing hanger 12 within the wellhead 24 to support the production tubing.

In the present example, the lock 22 comprises a lock ring and a wedge (not shown). In the unlocked position the lock ring is in a radially contracted state and the wedge is located above, and adjacent, the lock ring. When moving to a locked position, the wedge moves towards the lock ring. A cam surface of the wedge abuts the lock ring and urges the lock ring radially outwards into an expanded state. In this expanded state, the lock ring engages the wellhead 24 and locks the tubing hanger 12 with respect to the wellhead 24.

The wedge is configured to act upon the lock ring to force the lock ring into the wellhead-engaging position. The lock 22 is configured such, during use, the wedge moves downwards to engage the lock ring and a cam surface of the wedge forces the lock ring radially outwards, to engage the wellhead 24 and lock the tubing hanger 12 in place.

The tubing hanger running tool 10 is configured to actuate the lock 22 of the tubing hanger 12. This is done using tubing pressure—e.g. the fluid pressure within the tubing hanger running tool 10. This allows the tubing hanger 12 to be set without the use of an umbilical.

The tubing hanger running tool 10 comprises a locking actuator. The locking actuator is configured to engage and actuate the lock 22 of the tubing hanger 12. During use, the locking actuator is configured to move the lock 22 into a locked position, anchoring the tubing hanger 12 within the wellhead 24.

The locking actuator is configured to move between a running position and a locking position. In the running position, the locking actuator does not engage the tubing hanger lock 22 to move the lock 22 to the locking position. As such, in the running position, the locking actuator is configured such that the tubing hanger 12 can be moved into position within the wellhead 24. As the locking actuator is moved to the locking position, it engages the lock 22 of the tubing hanger 12 and moves the lock 22 into the wellhead-engaging position, causing the lock 22 to engage the wellhead 24 and anchor the tubing hanger 12 within the wellhead 24 and the production tubing 20 within the well.

More specifically, the locking actuator comprises a sleeve 26. The sleeve 26 is an annular piston and is free to move axially with respect to the body of the running tool 10. The sleeve 26 is configured to move between the running and locking positions. When moving to the locking position, the sleeve 26 moves axially towards the tubing hanger 12 and engages the lock 22 of the tubing hanger 12. As the sleeve 26 moves into the locking position, the sleeve 26 abuts the wedge and urges the wedge to abut the lock ring. The lock ring is therefore urged outwards as described above, putting the lock 22 into the locked position, in which the tubing hanger 12 is fixed with respect to the wellhead 24.

The sleeve 26 is moved from the running to the locking position under the action of fluid pressure. The blowout preventer (BOP) in which the tubing hanger 12 and tubing hanger running tool 10 are located comprises a ram (not shown) for isolating the annulus above the sleeve 26. The blowout preventer (BOP) further comprises a kill line. The kill line is a high-pressure fluid line between the mud pump and the blowout preventer. The kill line is arranged to be fluidically connected to the isolated annulus above the sleeve 26 (or locking actuator more broadly).

During use, when the tubing hanger 12 is in position within the wellhead, the ram of the BOP is activated. The ram moves radially inwards and isolates the annulus above the sleeve 26 from the rest of the annulus—i.e. that above the BOP ram. The kill line is then used to increase the pressure within the annulus above the sleeve 26. The pressure differential across the sleeve 26 urges the sleeve from the running position to the locking position. This causes the sleeve 26 of the locking actuator to engage the lock 22 of the tubing hanger 12, which in turn anchors the tubing hanger 12 within the wellhead.

In other examples, the locking actuator of the tubing hanger running tool 10 may move between positions under the action of tubing fluid pressure—that is the pressure of fluid within the tubing within the well. This may be achieved by the tubing hanger running tool 10 defining a locking flow path, configured to expose one side of the sleeve 26 to fluid pressure within the central flow path 18. The other side of the sleeve 26 may be exposed to annulus pressure and the pressure differential across the sleeve 26 may urge the sleeve 26 downwards, towards the tubing hanger 12.

The tubing hanger 12 is configured for use with a VXT. As such, the tubing hanger 12 includes an annulus bypass 30 arranged to provide fluid communication with an annulus below the tubing hanger 12. A bypass control valve 32 is provided in the bypass 30 to control fluid communication through the bypass 30.

Figure 3:
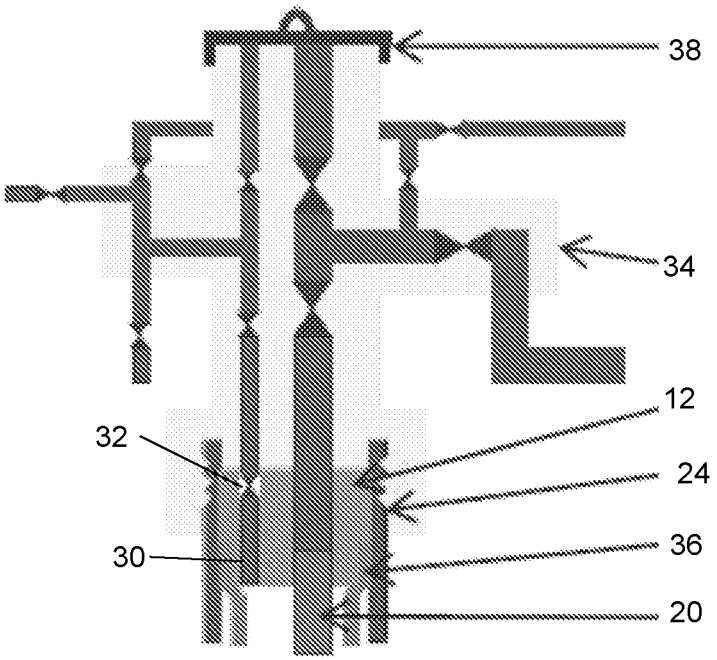
FIG. 3 is a schematic illustration of a tubing hanger and vertical Christmas tree.

FIG. 3 shows a tubing hanger 12 located within a wellhead 24 with a VXT 34 in place on top of the tubing hanger 12. The annulus bypass 30 and annulus bypass control valve 32 are shown, parallel to the tubing hanger flow path connected to the production tubing 20. A casing hanger 36 and Christmas tree cap 38 are also shown.

Turning back to FIG. 2, the bypass valve 32 is shown in the annulus bypass 30, which is a flow path providing access to the production tubing annulus. Use of the annulus bypass 30 allows certain tests and operations to be conducted during testing and use of the completion—for example pressure testing of the well.

An example of a suitable bypass valve 32 is a gate valve.

The tubing hanger running tool 10 is configured to operate the bypass valve 32 without the use of an umbilical. The tubing hanger running tool 10 comprises a bypass valve activating system 40 for opening and closing the bypass valve 32, without the use of an umbilical.

The tubing hanger running tool 10 is configured to operate the bypass valve 32 under the action of fluid pressure. The bypass valve activating system 40 comprises a fluid pressure line 42 for conveying fluid pressure to operate the bypass valve 32. A first end of the fluid pressure line 42 may be in communication with the bypass valve 32—for example via a piston in a pressure chamber for urging the piston to open/close the gate in the case of a gate valve. A second end of the fluid pressure line 42 may be in fluid communication with a fluid pressure source. This fluid pressure source may be the primary flow path through the running tool (i.e. tubing pressure), a choke/kill line of the blowout preventer installed as part of the completion; or an external or internal drill string pressure.

During use, the annulus bypass valve 32 may be shut during installation of the production tubing 20 to prevent fluid flow through the bypass. After the tubing hanger 12 is anchored to the wellhead 24, access may be required to the production tubing annulus and the annulus bypass valve 32 may need to be opened. To achieve this, the fluid pressure line 42 may need to be pressurised. If the fluid pressure line 42 is connected to the drill string tubing, this may be achieved by increasing the pressure within the drill string.

The bypass valve 32 or bypass valve activating system 40 may comprise a biasing means. The biasing means may be arranged to bias the valve 32 into the initial configuration. The bypass valve 32 may be moved back to the initial arrangement by removal of the fluid pressure in pressure line 42. The biasing means (e.g. a spring) may urge the bypass valve 32 back into the initial configuration following removal of the fluid pressure.

Figure 4:
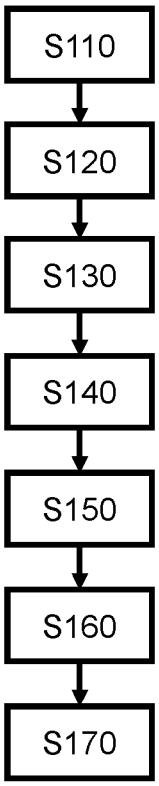
FIG. 4 is a flow chart showing a method for installing a tubing hanger in a well.

Turning now to FIG. 4, a method for installing a tubing hanger in a well without an umbilical is described, the method comprising the following steps:

- S110: running an assembly as described herein into a well;
- S120: locating the tubing hanger in the wellhead;
- S130: moving the locking actuator from the running position to the locking position under the action of fluid pressure in the well;
- S140: moving the tubing hanger lock from the unlocked position to the locked position under the action of the locking actuator, such that the tubing hanger is anchored in the wellhead;
- S150: using the bypass valve activating system to operate the bypass valve;
- S160: disconnecting the downhole tool from the tubing hanger; and
- S170: removing the downhole tool from the well.

Figure 5:
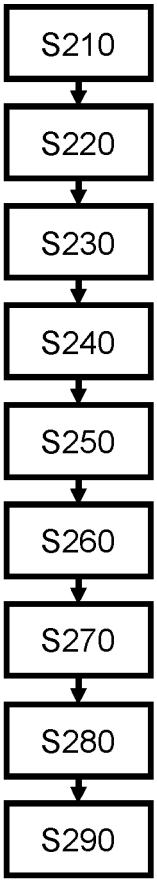
FIG. 5 is a flow chart showing a method for installing a completion in a well.

FIG. 5 relates to a method for running a completion in a well without an umbilical, comprising the following steps:

S210: running an assembly as described herein into a well;

S220: locating the tubing hanger in the wellhead;

S230: moving the locking actuator from the running position to the locking position under the action of fluid pressure in the well;

S240: moving the tubing hanger lock from the unlocked position to the locked position under the action of the locking actuator, such that the tubing hanger is anchored in the wellhead;

S250: using the bypass valve activating system to operate the bypass valve;

S260: disconnecting the downhole tool from the tubing hanger;

S270: removing the downhole tool from the well;

S280: landing a vertical Christmas tree; and

S290: testing the completion after the vertical Christmas tree has been installed in the well.

The vertical Christmas tree may be landed in the well as the next operational step following the landing of the tubing hanger.

The present invention has been described above purely by way of example. Modifications in detail may be made to the present invention within the scope of the claims as appended hereto. Furthermore, features from one example may be combined with an alternative example unless such a combination is explicitly precluded.

The invention claimed is:

1. A downhole tool for installing a tubing hanger in a well without an umbilical, the tool comprising:

a body defining a primary flow path;

a first connector at a first end of the body for mechanically connecting the tool to the tubing hanger;

a second connector at a second end of the body for mechanically connecting the tool to a tubular or tool handling equipment;

a locking actuator configured to move from a running position to a locking position under an action of fluid pressure, wherein the actuator comprises an interface for engaging and moving a lock of the tubing hanger into a locked position as the actuator moves to the locking position; and a bypass valve activating system configured to operate a tubing hanger annulus bypass valve, wherein the downhole tool is configured to move the locking actuator from the running position to the locking position, and operate the tubing hanger annulus bypass valve, without a use of the umbilical, wherein the bypass valve activating system comprises a fluid pressure line for conveying fluid pressure to operate the tubing hanger annulus bypass valve, and wherein the fluid pressure line is:

in fluid communication with the primary flow path for conveying tubing pressure;

configured to connect to a choke/kill line of a blow-out preventer; or configured to connect to an external or internal drill string pressure.

2. The tool of claim 1, wherein:

the locking actuator comprises a sleeve; and the interface is an abutment surface of the sleeve and the sleeve is configured to move axially with respect to the body from the running position to the locking position under the action of fluid pressure.

3. The tool of claim 1, further comprising a return pressure line configured to convey an annulus pressure to a first end of the tool.

4. The tool of claim 3, wherein the return pressure line is configured to be isolated from the annulus pressure when the locking actuator is in the running position, but in fluid communication with the annulus pressure when the locking actuator is in the locking position.

5. A downhole assembly, the assembly comprising:

the downhole tool according to claim 1; and a tubing hanger connected to the downhole tool, wherein the tubing hanger comprises:

a lock configured to move between an unlocked position and a locked position for engaging a wellhead and anchoring the tubing hanger to the wellhead, wherein the lock is configured to cooperate with the locking actuator of the downhole tool and move from the unlocked position to the locked position under the action of the locking actuator;

an annulus bypass configured to provide fluid communication with an annulus below the tubing hanger; and a bypass valve arranged in the annulus bypass and configured to control fluid communication through the annulus bypass, wherein the bypass valve is connected to the bypass valve activating system and is configured to move between an open and a closed arrangement under an action of the bypass valve activating system.

6. The downhole assembly according to claim 5, wherein the lock comprises a lock ring and a wedge, wherein the lock is arranged such that the wedge is acted upon by the locking actuator of the downhole tool as the locking actuator moves to the locking position, and wherein the wedge is moved to engage the lock ring, forcing the lock ring radially outwards into a wellhead-engaging position.

7. The downhole assembly according to claim 5, wherein the bypass valve comprises a gate valve.

8. The downhole assembly of claim 5, further comprising a blowout preventer.

9. The downhole assembly of claim 8, wherein the blowout preventer comprises:

a ram configured to isolate an annular area above the locking actuator; and a fluid line in fluid communication with the annular area above the locking actuator.

10. A method for installing a tubing hanger in a well without an umbilical, comprising:

running the downhole assembly according to claim 5 into a well;

locating the tubing hanger in the wellhead;

moving the locking actuator from the running position to the locking position under an action of fluid pressure in the well;

moving the tubing hanger lock from the unlocked position to the locked position under the action of the locking actuator, such that the tubing hanger is anchored in the wellhead;

using the bypass valve activating system to operate the bypass valve;

disconnecting the downhole tool from the tubing hanger; and removing the downhole tool from the well.

11. A method for running a completion in a well without an umbilical, comprising:

running the downhole assembly according to claim 5 into a well;

locating the tubing hanger in the wellhead;

moving the locking actuator from the running position to the locking position under an action of fluid pressure in the well;

moving the tubing hanger lock from the unlocked position to the locked position under the action of the locking actuator, such that the tubing hanger is anchored in the wellhead;

using the bypass valve activating system to operate the bypass valve;

disconnecting the downhole tool from the tubing hanger;

removing the downhole tool from the well;

landing a vertical Christmas tree; and testing a competition after the vertical Christmas tree has been installed in the well.

12. The method of claim 11, wherein the vertical Christmas tree is landed in the well as a next operational step following the landing of the tubing hanger.

* * * * *